US009470138B2

(12) United States Patent
Miyagawa

(10) Patent No.: US 9,470,138 B2
(45) Date of Patent: Oct. 18, 2016

(54) COOLANT CIRCULATION SYSTEM FOR ENGINE

(71) Applicant: DENSO CORPORATION, Kariya, Aichi-pref. (JP)

(72) Inventor: Masashi Miyagawa, Ichinomiya (JP)

(73) Assignee: DENSO CORPORATION, Kariya (JP)

( * ) Notice: Subject to any disclaimer, the term of this patent is extended or adjusted under 35 U.S.C. 154(b) by 228 days.

(21) Appl. No.: 13/721,961

(22) Filed: Dec. 20, 2012

(65) Prior Publication Data

US 2013/0160723 A1 Jun. 27, 2013

(30) Foreign Application Priority Data

Dec. 22, 2011 (JP) ..... 2011-281643

(51) Int. Cl.
*F01P 7/16* (2006.01)
*F01P 3/02* (2006.01)

(52) U.S. Cl.
CPC ..... *F01P 7/16* (2013.01); *F01P 7/167* (2013.01); *F01P 2003/027* (2013.01); *F01P 2060/04* (2013.01); *F01P 2060/08* (2013.01); *F01P 2060/16* (2013.01)

(58) Field of Classification Search
CPC ..... F01P 7/14; F01P 2007/146; F01P 7/16; F01P 7/165; F01P 7/167
See application file for complete search history.

(56) References Cited

U.S. PATENT DOCUMENTS 4,726,324 A * 2/1988 Itakura ..... 123/41.1
2007/0137592 A1* 6/2007 Hanai ..... 123/41.14
2008/0168956 A1* 7/2008 Lutz et al. ..... 123/41.1
2011/0259287 A1* 10/2011 Kakehashi et al. ..... 123/41.09

FOREIGN PATENT DOCUMENTS

| | | |
|---|---|---|
| CN | 201606141 | 10/2010 |
| JP | 6-193443 | 7/1997 |
| JP | 2003-269168 | 9/2003 |
| JP | 2005-83239 | 3/2005 |
| JP | 2005-315106 | 11/2005 |
| JP | 2010-163920 | 7/2010 |
| JP | 2011-149385 | 8/2011 |

OTHER PUBLICATIONS

Office Action (2 pages) dated Apr. 1, 2014, issued in corresponding Japanese Application No. 2011-281643 and English translation (3 pages).
Office Action (7 pages) dated Jul. 22, 2014, issued in corresponding Chinese Application No. 201210562341.9 and English translation (9 pages).

* cited by examiner

*Primary Examiner* — Lindsay Low
*Assistant Examiner* — Jacob Amick
(74) *Attorney, Agent, or Firm* — Nixon & Vanderhye P.C.

(57) ABSTRACT

A coolant circulation system for an engine includes a cylinder block passage and a cylinder head passage, which are provided respectively in a cylinder block portion and a cylinder head portion of the engine. These two passages serve as passages through which a coolant flows to cool the cylinder block portion and the cylinder head portion. The cylinder block passage and the cylinder head passage are connected in parallel to each other. The coolant circulation system further includes a first heat exchanger connected to the cylinder block passage, a second heat exchanger connected to the cylinder head passage, a radiator connected to both the cylinder block passage and the cylinder head passage, and a control unit capable of controlling flow rates of the coolant flowing through the cylinder block passage and the cylinder head passage respectively.

17 Claims, 3 Drawing Sheets

COOLANT CIRCULATION SYSTEM FOR ENGINE

CROSS REFERENCE TO RELATED APPLICATION

This application is based on and incorporates herein by reference Japanese Patent Application No. 2011-281643 filed on Dec. 22, 2011.

TECHNICAL FIELD

The present disclosure relates to a coolant circulation system in which a coolant flows through a cylinder block portion and a cylinder head portion of an engine to cool the engine.

BACKGROUND

When an engine is warmed up, it is preferable that a temperature of lubricant oil for the engine is increased quickly so as to reduce a friction loss between a cylinder block portion and pistons of the engine, for example. In this case, a temperature (cylinder block temperature) of the cylinder block portion may be increased in preference to increasing a temperature (cylinder head temperature) of a cylinder head portion of the engine having a combustion chamber. Accordingly, the friction loss can be reduced effectively.

In a circulation system described in Patent Document 1 (JP 6-193443 A), a cylinder block portion of an engine has a cylinder block passage through which a coolant flows, and a cylinder head portion of the engine has a cylinder head passage though which the coolant flows. The cylinder block passage and the cylinder head passage are connected in parallel. In a warm-up operation of the engine, a coolant temperature (cylinder block temperature) in the cylinder block portion is increased more rapidly than a coolant temperature (cylinder head temperature) in the cylinder head portion is, by reducing an open degree of a control valve that controls a flow rate (cylinder-block flow rate) of the coolant flowing thorough the cylinder block portion.

Recently, an engine is equipped with an exhaust gas recirculation system (EGR system) in which a part of exhaust gas adapted as EGR gas flows back to an intake side of the engine, and the EGR gas is cooled by an EGR cooler. The EGR cooler, i.e., a heat exchanger is provided in an EGR pipe that connects an intake pipe and an exhaust pipe, and the EGR cooler exchanges heat between the EGR gas and a coolant. Here, a coolant used for the engine is generally distributed to the EGR cooler, and in this case, it is preferable that the coolant is distributed to the EGR cooler at a flow rate optimized for heat exchange in the EGR cooler.

In addition to the EGR cooler, there are various heat exchangers and portions to which coolant is required to be distributed. The various heat exchangers and portions include a coolant passage (heat exchanger) provided in an EGR valve that controls a flow rate of the EGR gas, a coolant passage (heat exchanger) provided in a throttle valve that adjusts an intake air amount, an oil warmer (heat exchanger) that heats lubricant oil, and a heater core (heat exchanger) that heats conditioned air. When the coolant is distributed to these heat exchangers, a coolant flow rate distributed to each of the heat exchangers is preferably adjusted at a coolant flow rate desired for heat exchange performed in each of them.

However, the above-described conventional circulation system does not have a device that controls a coolant flow rate (cylinder-head flow rate) in the cylinder head passage. Thus, the cylinder-head flow rate is increased in accordance with decrease of the open degree of the control valve that controls the cylinder-block flow rate. Therefore, the cylinder-block flow rate is adjustable independently, but the cylinder-head flow rate may be unadjustable independently. When the coolant is distributed to the above-described various heat exchangers from the cylinder head passage in the conventional circulation system, the coolant may not be distributed to the heat exchangers at the desired flow rates.

Also when the coolant is distributed to the various heat exchangers from the cylinder block passage, the coolant may not be distributed to the heat exchangers at the desired flow rates in a case where the cylinder-block flow rate is reduced during the engine warm-up operation.

SUMMARY

An objective of the present disclosure is to provide a coolant circulation system for an engine, which distributes coolant to heat exchangers at flow rates respectively required in the heat exchangers while warm-up of the engine is accelerated.

According to an aspect of the present disclosure, a coolant circulation system is used for an engine that includes a cylinder block portion and a cylinder head portion. The coolant circulation portion includes a cylinder block passage, a cylinder head passage, a first heat exchanger, a second heat exchanger, a radiator and a control unit. The cylinder block passage is provided in the cylinder block portion to serve as a passage through which a coolant flows to cool the cylinder block portion, and the cylinder head passage is provided in the cylinder head portion to serve as a passage through which the coolant flows to cool the cylinder head portion. The cylinder block passage and the cylinder head passage are connected in parallel to each other. The first heat exchanger is connected to an outlet of the cylinder block passage, and the second heat exchanger is connected to an outlet of the cylinder head passage. The radiator is connected to both the outlet of the cylinder block passage and the outlet of the cylinder head passage. The control unit is configured to be capable of controlling a flow rate of the coolant flowing through the cylinder block passage and a flow rate of the coolant flowing through the cylinder head passage respectively.

Accordingly, the flow rate (cylinder-head flow rate) of the cylinder head passage and the flow rate (cylinder-block flow rate) of the cylinder block passage can be controlled respectively. Thus, the cylinder-head flow rate can be increased while the cylinder-block flow rate is reduced to promote warm-up of the engine. As a result, the coolant can be distributed to the first and second heat exchangers at desired flow rates, and the warm-up operation can be promoted.

A heat exchanger, in which a desired flow rate of the coolant for heat exchange therein is approximately same as the cylinder-head flow rate in the warm-up operation of the engine, may be used as the second heat exchanger. In this case, the coolant can be distributed to the second heat exchanger at a desired flow rate of the second heat exchanger, and the warm-up operation can be accelerated.

The first heat exchanger may be a heat exchanger in which a desired flow rate of the coolant for heat exchange therein is lower than a predetermined value. The second heat exchanger may be a heat exchanger in which a desired flow rate of the coolant for heat exchange therein is higher than the predetermined value.

In the warm-up operation, it is effective for reducing a friction loss between the cylinder block portion and pistons that a temperature (cylinder block temperature) of the cylinder block portion is increased in preference to increase of a temperature (cylinder head temperature) of the cylinder head portion. It is effective for increasing the cylinder block temperature in the warm-up operation that the cylinder-block flow rate is set lower than the cylinder-head flow rate.

Therefore, in the warm-up operation, the coolant may be distributed to the low-flow-rate heat exchanger from the cylinder block passage in which a coolant flow rate is relatively low, and the coolant may be distributed to the high-flow-rate heat exchanger from the cylinder head passage in which a coolant flow rate is relatively high. As a result, the coolant can be distributed to the first and second heat exchangers at the desired flow rates, and the warm-up of the engine can be accelerated.

The second heat exchanger may include an EGR cooler that cools EGR gas through heat exchange with the coolant flowing therethrough, and the EGR gas is a part of exhaust gas flowing back to an intake side of the engine. The coolant circulation system may further include a first bypass passage through which the coolant bypasses the radiator, and a thermostat that controls the coolant to flow through the first bypass passage when a coolant temperature is equal to or lower than a preset temperature of the thermostat. The preset temperature of the thermostat may be set higher than a temperature below which moisture contained in the EGR gas condenses, and lower than a target coolant temperature in the cylinder block portion. The target coolant temperature in the cylinder block portion may be a temperature at which friction loss between the cylinder block portion and the pistons is lower than a predetermined value.

When the warm-up operation is finished, the cylinder block temperature is different from the cylinder head temperature in optimum value. When the cylinder head temperature is too low, the moisture contained in the EGR gas may be cooled excessively to condense, and the condensed moisture may erode a metallic component, for example. When the cylinder head temperature is too high, knocking may occur in a case where a driver presses a gas pedal to accelerate a vehicle. Based on these, the optimum value of the cylinder head temperature may be determined. On the other hand, the optimum value of the cylinder block temperature may be determined so that the fiction loss becomes equal to or lower than the predetermined value.

Hence, it is effective for preventing the knocking that the cylinder head temperature is set lower than the optimum value (e.g., 90° C.) of the cylinder block temperature after the warm-up operation is finished. Moreover, the cylinder head temperature may be higher than the condensation temperature below which the moisture contained in the EGR gas condenses.

In general, the preset temperature of the thermostat may be set based on the friction loss. In this case, the cylinder head temperature can be increased easily to be higher than a temperature (head inflow temperature) controlled by the thermostat. However, the cylinder head temperature may be difficult to be reduced to be lower than the head inflow temperature.

Therefore, the preset temperature of the thermostat may be set lower than the target coolant temperature in the cylinder block portion (i.e., the optimum value of the cylinder block temperature), and higher than the condensation temperature of the moisture contained in the EGR gas. Accordingly, the cylinder head temperature can be set at the optimum value thereof easily.

In this case, the temperature (head inflow temperature) controlled by the thermostat may often be lower than the optimum value of the cylinder block temperature, and the cylinder block temperature can be increased easily by reducing the cylinder-block flow rate. Accordingly, the cylinder block temperature also can be set at the optimum temperature (target coolant temperature) thereof easily.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

An exemplar embodiment of the present disclosure will be described hereinafter referring to drawings.

Figure 1:
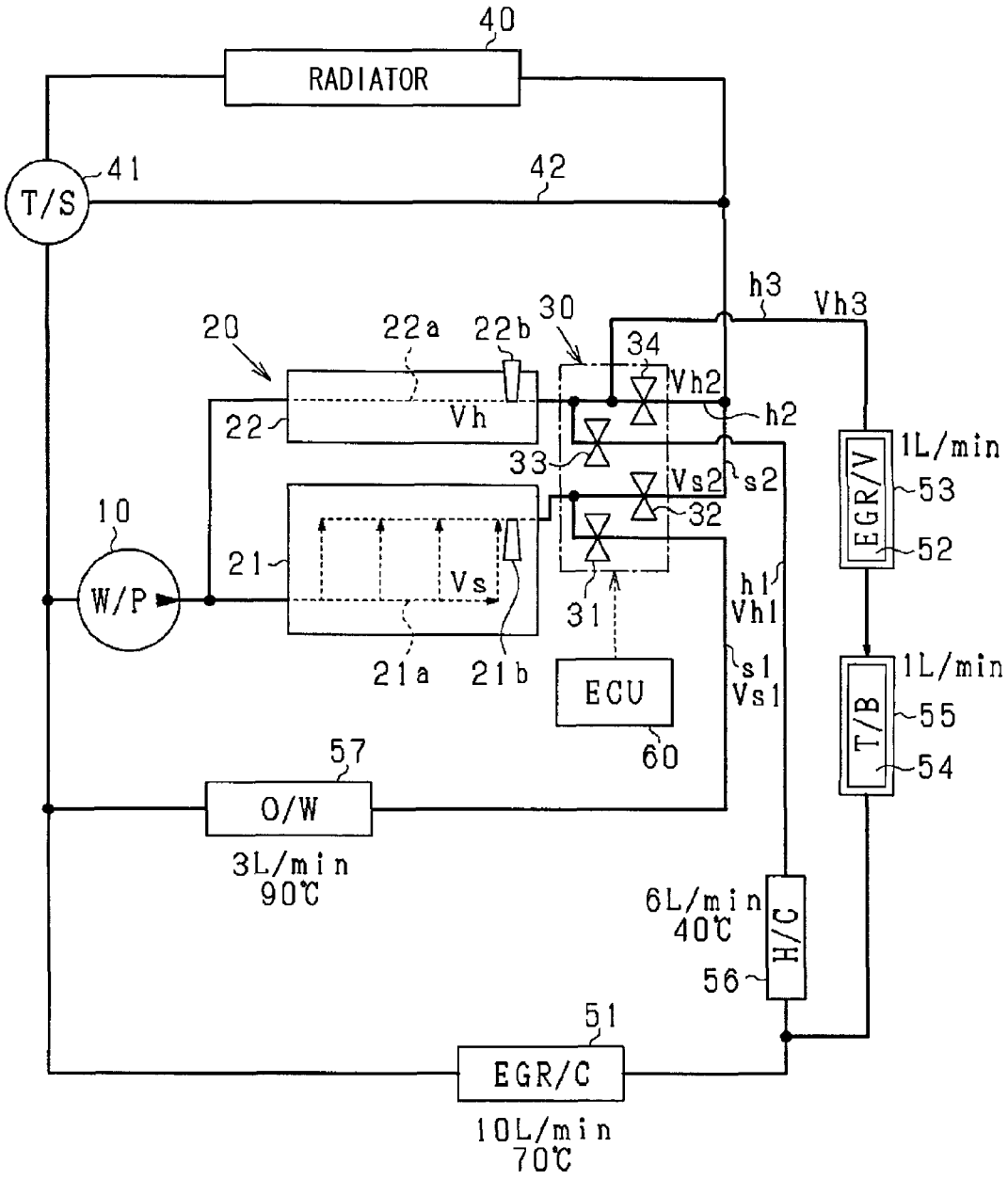
FIG. 1 is a schematic diagram showing a coolant circulation system for an engine, according to an exemplar embodiment of the present disclosure.

In a coolant circulation system of an exemplar embodiment shown in FIG. 1, a coolant discharged from a pump 10 passes through water jackets provided respectively in a cylinder block portion 21 and a cylinder head portion 22 of an engine 20. The water jacket provided in the cylinder block portion 21 is a cylinder block passage 21*a*, and the water jacket provided in the cylinder head portion 22 is a cylinder head passage 22*a*. The cylinder block passage 21*a* and the cylinder head passage 22*a* are connected in parallel to each other as shown in FIG. 1. The cylinder block portion 21 accommodates therein pistons, and the cylinder head portion 22 defines a combustion chamber of the engine 20.

The coolant flowing out of the cylinder block passage 21*a* and the cylinder head passage 22*a* flows into a radiator 40 through a control valve unit 30 to exchange heat with outside air in the radiator 40. Subsequently, the coolant returns to the pump 10. Thus, the coolant circulates in an order: the pump 10→the cylinder block portion 21 and the cylinder head portion 22→the control valve unit 30→the radiator 40→the pump 10. The control valve unit 30 is used as an example of a control unit configured to be capable of controlling a flow rate of the coolant flowing through the cylinder block passage 21*a* and a flow rate of the coolant flowing through the cylinder head passage 22*a* respectively.

A thermostat 41 is provided downstream of the radiator 40 in a flow of the coolant, and is opened when a coolant temperature is larger than a preset temperature (e.g., 90° C.). Hence, when the engine 20 is warmed up in a warm-up operation, the thermostat 41 is closed so that the coolant circulates through a bypass passage 42 (first bypass passage) that bypasses the radiator 40. Accordingly, warming of the coolant temperature is accelerated, and temperature warming of the cylinder block portion 21 and the cylinder head portion 22 are thereby accelerated. As a result, the engine 20 can be warmed up quickly.

The engine 20 shown in FIG. 1 includes an exhaust gas circulation system (EGR system) in which a part of exhaust gas adapted as EGR gas flows back to an intake side of the engine 20. The EGR system includes an EGR cooler 51 that cools the EGR gas via heat exchange with the coolant, and an EGR valve 52 that controls a flow rate of the EGR gas. The EGR valve 52 has a cooling jacket 53 through which the coolant passes, and the EGR valve 52 is cooled via heat exchange with the coolant passing through the cooling jacket 53.

A throttle valve 54 that adjusts a flow rate of intake air has a cooling jacket 55 through which the coolant flows. The throttle valve 54 is cooled via heat exchange with the coolant passing through the cooling jacket 55. The coolant circulating due to pumping of the pump 10 is used also as a heat exchange medium in a heater core 56 (heat exchanger) and an oil warmer 57 (heat exchanger). The heater core 56 heats conditioned air blown into a vehicle compartment via heat exchange with the coolant. The oil warmer 57 heats lubricant oil used for sliding surfaces, for example, between cylinder liners and the pistons of the engine 20, or heats lubricant oil used for a transmission device via heat exchange with the coolant.

The control valve unit 30 includes control valves 31, 32 that control a flow rate (cylinder-block flow rate Vs) in the cylinder block passage 21*a*, and control valves 33, 34 that control a flow rate (cylinder-head flow rate Vh) in the cylinder head passage 22*a*. Opening and closing operations of these control valves 31 to 34 are actuated by an electric control unit 60 (ECU).

A coolant temperature (cylinder block temperature Ts) flowing at an outlet of the cylinder block passage 21 a is detected by a cylinder-block temperature sensor 21*b*, and a coolant temperature (cylinder head temperature Th) flowing at an outlet of the cylinder head passage 22*a* is detected by a cylinder-head temperature sensor 22*b*. The ECU 60 controls the control valves 31 to 34 based on the cylinder block temperature and the cylinder head temperature detected by the temperature sensors 21*b* and 22*b*.

The coolant flowing out of the cylinder block passage 21*a* is distributed to the oil warmer 57 through a distribution passage s1 (first distribution passage) and to the radiator 40 through a radiator passage s2 (first radiator passage). The control valve 31 controls a flow rate Vs1 in the distribution passage s1, and the control valve 32 controls a flow rate Vs2 in the radiator passage s2. Hence, when open degrees of both of the control valves 31 and 32 are reduced, the cylinder-block flow rate Vs can be reduced. In other words, the cylinder-block flow rate Vs can be adjusted by the controls of the control valves 31, 32. The oil warmer 57 is used as an example of a first heat exchanger connected to an outlet of the cylinder block passage 21*a* via the distribution passage s1.

The coolant flowing out of the cylinder head passage 22*a* is distributed to the heater core 56 and the EGR cooler 51 through a distribution passage h1 (second distribution passage), to the radiator 40 through a radiator passage h2 (second radiator passage), and to the cooling jackets 53, 55 through a distribution passage h3. The control valve 33 controls a flow rate Vh1 in the distribution passage h1, and the control valve 34 controls a flow rate Vh2 in the radiator passage h2. The heater core 56 and the EGR cooler 51 are used as examples of a second heat exchanger connected to an outlet of the cylinder head passage 22*a* via the distribution passage h1. The radiator 40 is connected to both the outlet of the cylinder block passage 21*a* via the radiator passage s2 and the outlet of the cylinder head passage 22*a* via the radiator passage h2. The control valve 31 is used as an example of a first control valve provided in the distribution passage s1 to control a flow rate of the coolant flowing therethrough, and the control valve 33 is used as an example of a second control valve provided in the distribution passage h1 to control a flow rate of the coolant flowing therethrough. The control valve 32 is used as an example of a third control valve provided in the radiator passage s2 to control a flow rate of the coolant flowing therethrough, and the control valve 34 is used as an example of a fourth control valve provided in the distribution passage h2 to control a flow rate of the coolant flowing therethrough.

The distribution passage h3 is always in communication with the cylinder head passage 22*a* so that a part of the coolant flowing out of the cylinder head passage 22*a* continuously flows into the cooling jackets 53 and 55. A desired flow rate Vh3 of the coolant for heat exchange in the cooling jackets 53 and 55 is lower than desired flow rates for heat exchanges in the heat exchangers 51, 56, 57. A pipe diameter of the distribution passage h3 is set such that the coolant passes therethrough at the desired flow rate Vh3. Hence, when open degrees of both the control valves 33 and 34 are reduced, the cylinder-head flow rate Vh can be reduced. In other words, the cylinder-head flow rate Vh can be adjusted by the controls of the control valves 33, 34.

Flow rates desired for heat exchanges in the EGR cooler 51, the heater core 56, the oil warmer 57, the cooling jacket 53 and the cooling jacket 55 are set respectively at 10 L/min (EGR-cooler flow rate), 6 L/min (heater-core flow rate), 3 L/min, 1 L/min and 1 L/min, for example. In other words, the desired flow rate of the coolant reduces in the following order: the EGR cooler 51, the heater core 56, the oil warmer 57, the cooling jacket 53 and the cooling jacket 55.

In the EGR cooler 51 and the heater core 56, the desired flow rates of the coolant are higher than a predetermined value (e.g., 5 L/min), and the EGR cooler 51 and the heater core 56 may thereby correspond to a high-flow-rate heat exchanger. The EGR cooler 51 and the heater core 56 are connected in series with each other in the distribution passage h1 to be supplied the coolant from the cylinder head passage 22*a*. In the oil warmer 57, the desired flow rate of the coolant is lower than the predetermined value, and the oil warmer 57 may thereby correspond to a low-flow-rate heat exchanger. The oil warmer 57 is connected to the distribution passage s1 to be supplied the coolant from the cylinder block passage 21*a*.

In the cooling jackets 53, 55, the desired flow rate of the coolant is lower than that in the low-flow-rate heat exchanger and cannot be adjusted. Thus, the cooling jackets 53 and 55 may correspond to an extremely-low-flow-rate heat exchanger (third heat exchanger), and are connected in series in the distribution passage h3 to be supplied the coolant from the cylinder head passage 22*a*. The cooling jackets 53 and 55 bypass the heater core 56 through the distribution passage h3, and are connected to the EGR cooler 51 in series. Here, the required flow rate in the EGR cooler 51 is larger than the sum of the required flow rates of the cooling jackets 53, 55 and the heater core 56. The distribution passage h3 is used as an example of a second bypass passage that is connected to the outlet of the cylinder head passage 22*a* and bypasses the heater core 56.

When the coolant flows through the EGR cooler 51 at a temperature lower than a condensation temperature (e.g., 60° C.) of moisture contained in the EGR gas, the EGR gas may be cooled excessively by the EGR cooler 51 so that the moisture contained in the EGR gas may be condensed. The condensed moisture may erode metallic components such as an EGR pipe and the EGR valve 52. However, when the coolant flows through the EGR cooler 51 at a temperature equal to or more than the condensation temperature, the coolant temperature may set as low as possible above the condensation temperature so that a cooling capacity of the EGR cooler 51 is improved. Therefore, the temperature of the coolant distributed to the EGR cooler 51 may be set at a temperature (e.g., 70° C.) higher sufficiently than the condensation temperature by 10 degrees for example.

A temperature of the coolant distributed to the heater core 56 may be set at a reference temperature, for example, 40° C. When the coolant flows through the heater core 56 below the reference temperature, conditioned air blown into the vehicle compartment may be heated insufficiently in the heater core 56. Therefore, the control valve unit 30 adjusts a flow rate of the coolant flowing through the heater core at the heater-core flow rate when a temperature of the coolant is higher than the reference temperature. The control valve 30 adjusts the flow rate of the coolant flowing through the heater core at a flow rate lower than the heater-core flow rate when the temperature of the coolant is equal to or lower than the reference temperature.

A largest flow rate of the coolant distributed from the cylinder head passage 22*a* to the high-flow-rate heat exchanger (51, 56) may be set at the desired flow rate (e.g., 10 L/min) in the EGR cooler 51. A lowest temperature of the coolant distributed from the cylinder head passage 22*a* to the high-flow-rate heat exchanger (51, 56) may be set at a lowest coolant temperature (e.g., 70° C.) in the EGR cooler 51. The desired flow rate of the coolant in the low-flow-rate heat exchanger (57), which is distributed from the cylinder block passage 21*a*, is set at 3 L/min for example as described above. Hence, the desired flow rate in the low-flow-rate heat exchanger (57) is lower than the desired flow rate in the high-flow-rate heat exchanger (51,56).

A temperature of the coolant distributed to the oil warmer 57 may be higher than a temperature of oil that is an object to be heat-exchanged in the oil warmer 57. An upper limit temperature of the coolant distributed to the oil warmer 57 is higher than that of the coolant distributed to the EGR cooler 51.

Figure 2:
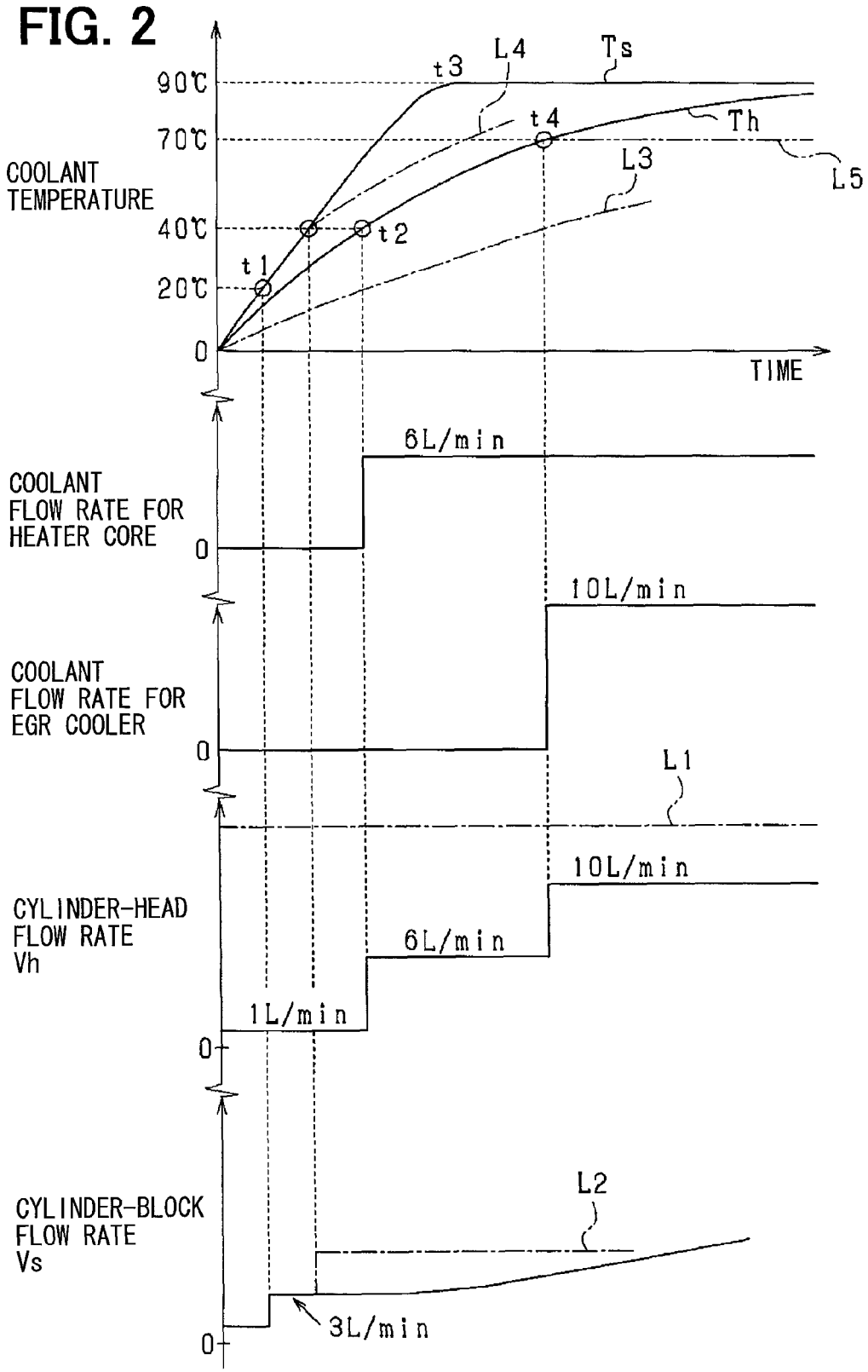
FIG. 2 is a time chart showing changes of various temperatures and flow rates in the coolant circulation system according to the exemplar embodiment.

Next, a control of the control valve unit 30 in the warm-up operation will be described with reference to FIG. 2. FIG. 2 is a time chart showing changes of various temperatures and flow rates when the warm-up operation of the engine 20 is started at 0° C. of the coolant temperature.

An optimum value of the cylinder block temperature Ts may be 90° C. for example. Thus, the open degrees of the control valves 31, 32 are controlled so that the cylinder-block flow rate Vs becomes as low as possible until a detection value of the cylinder-block temperature sensor 21*b* reaches the optimum value. Accordingly, elevation of the cylinder block temperature can be promoted.

As shown In FIG. 2, the control valve 31 is fully closed, in other words, the flow rate Vs1 in the distribution passage s1 is set at 0 L/min, and the control valve 32 is slightly open, in other words, the flow rate Vs2 in the radiator passage s2 is set at 1 L/min from the start until time t1 at which the cylinder block temperature Ts reaches a lower limit temperature (e.g., 20° C.) of the oil warmer 57. After time t1, the control valve 31 is fully open, in other words, the flow rate Vs1 is set at 3 L/min, and the control valve 32 is fully closed, in other words, the flow rate Vs2 is set at 0 L/min, so that the coolant is distributed to the oil warmer 57 at the required flow rate of the oil warmer 57. Subsequently, the cylinder block temperature Ts reaches the optimum value (e.g., 90° C.) thereof at time t3. After time t3, the open degree of the control valve 32 is adjusted so that the cylinder block temperature Ts is kept at the optimum value thereof.

An optimum value of the cylinder head temperature Th may be 70° C., for example. The open degrees of the control valves 33, 34 are controlled so that the cylinder-head flow rate Vh becomes as low as possible until a detection value of the cylinder-head temperature sensor 22*b* reaches the optimum value. Accordingly, elevation of the cylinder head temperature Th can be promoted.

As shown in FIG. 2, the control valve 33 is fully closed, in other words, the flow rate Vh1 in the distribution passage h1 is set at 0 L/min, and the control valve 34 is also fully closed, in other words, the flow rate Vh2 in the radiator passage h2 is set at 0 L/min from the start until time t2 at which the cylinder head temperature Th reaches the reference temperature (e.g., 40° C.), i.e., a lower limit temperature of the heater core 56. Thus, the cylinder-head flow rate Vh is equal to the flow rate Vh3 of the coolant flowing through the cooling jackets 53 and 55, in other words, the cylinder-head flow rate Vh is set at 1 L/min. After time t2, the control valve 33 is open, in other words, the flow rate Vh1 is set at 6 L/min, and the control valve 34 is fully closed, in other words, the flow rate Vh2 is set at 0 L/min, so that the coolant is distributed to the heater core 56 at the required flow rate of the heater core 56.

Subsequently, the open degree of the control valve 33 is enlarged at time t4, at which the cylinder head temperature Th reaches a lower limit temperature (e.g., 70° C.) of the EGR cooler 51, so that the coolant is distributed to the EGR cooler 51 at the required flow rate of the EGR cooler 51. For example, in FIG. 2, the control valve 33 is fully opened, and the control valve 34 is fully closed at time t4. After time t4, the open degree of the control valve 34 is adjusted so that the cylinder head temperature Th becomes the optimum value thereof.

If the control valves 33, 34 are omitted, the cylinder-head flow rate Vh cannot be controlled. Thus, as shown by a dashed-dotted L1 in FIG. 2, the cylinder-head flow rate Vh is set always at a largest value, and cannot be reduced. As a result, the cylinder head temperature Th may increase slowly as shown by a dashed-dotted L3 in FIG. 2, and the warm-up operation cannot be thereby promoted.

If the coolant is distributed from the cylinder block passage 21*a* to the heater core 56, the control valve 31 is required to be opened when the cylinder block temperature Ts reaches the reference temperature (e.g., 40° C. in FIG. 2). Therefore, as shown by a dashed-dotted L2 in FIG. 2, the cylinder-block flow rate Vs increases in the warm-up operation. As a result, the cylinder block temperature Ts may increase slowly as shown by a dashed-dotted L4 in FIG. 2, and the warm-up operation cannot be thereby promoted.

In the above-described embodiment, the cylinder-head flow rate Vh and the cylinder-block flow rate Vs can be controlled respectively by using the control valve unit 30 though the pump 10 is mechanically operated by drive force generated by the engine 20.

The cylinder-head flow rate Vh necessary for keeping the cylinder head temperature Th at the optimum value thereof is higher than the cylinder-block flow rate Vs necessary for keeping the cylinder block temperature Ts at the optimum value thereof. Additionally, the optimum value of the cylinder head temperature Th is lower than the optimum value of the cylinder block temperature Ts. Based on these, the coolant flowing out of the cylinder head passage 22*a* is distributed to the EGR cooler 51 and the heater core 56 because the coolant flowing through the ERG cooler 51 and the heater core 56 is required to have a low temperature and a high flow rate as compared to the coolant flowing through the oil warmer 57. As a result, the coolant can be distributed to the EGR cooler 51 and the heater core 56 at the required flow rate while the elevations of the cylinder block temperature Ts and the cylinder head temperature Th can be promoted. In other words, the warm-up operation can be promoted while the coolant can be distributed to the EGR cooler 51 and the heater core 56 at the required flow rate.

In the exemplar embodiment, the preset temperature of the thermostat 41 is set at the optimum value of the cylinder block temperature Ts that is a target coolant temperature in the cylinder block portion 21. Alternatively, the preset temperature of the thermostat 41 may be set lower than the target coolant temperature in the cylinder block portion 21, and higher than the condensation temperature below which the moisture contained in the EGR gas condenses.

The target coolant temperature (e.g., 90° C.) of the cylinder block portion 21 is a temperature at which friction loss between the cylinder block portion 21 and the pistons accommodated in the cylinder block portion 21 is smallest. When the cylinder block temperature Ts decreases, viscosity of the lubricant oil increases, and the friction loss between the cylinder block portion 21 and the pistons may thereby increase. When the cylinder block temperature Ts increases, the pistons expand due to heat, and the friction loss between the cylinder block portion 21 and the pistons may thereby increase. Therefore, the target coolant temperature in the cylinder block portion 21 is set at the temperature at which the friction loss is smallest, in consideration of the balance between the viscosity of the lubricant oil and the heat expansion of the pistons.

The optimum value (e.g., 70° C.) of the cylinder head temperature Th, i.e., a target coolant temperature in the cylinder head portion 22 is lower than the optimum value of the cylinder block temperature Ts. Because the cylinder head temperature Th has little influence on a temperature of the lubricant oil as compared with the cylinder block temperature Ts, the optimum value of the cylinder head temperature Th may be set lower than the optimum value of the cylinder block temperature Ts. The cylinder head temperature Th has great influence on a temperature of the combustion chamber in the engine 20. Hence, when the cylinder head temperature Th is higher than the optimum value thereof (e.g., 70° C.), knocking may be generated in the combustion chamber of the engine 20 in a case where a driver presses on a gas pedal to accelerate a vehicle.

When the cylinder head temperature Th is reduced too much, the EGR gas may be cooled excessively through heat exchange with the coolant distributed to the EGR cooler 51. As a result, the moisture contained in the EGR gas may be condensed. Hence, the target coolant temperature in the cylinder head portion 22 is set higher than the condensation temperature of the moisture, and lower than the target coolant temperature in the cylinder block portion 21.

Here, if the preset temperature of the thermostat 41 is set at the target coolant temperature in the cylinder block portion 21, a temperature of the coolant may be higher than the target coolant temperature in the cylinder head portion 22 after the warm-up operation. Consequently, the cylinder head temperature Th may be difficult to be reduced to be the optimum value thereof after the warm-up operation. When the preset temperature of the thermostat 41 is set at the target coolant temperature in the cylinder head portion 22, in other words, when the preset temperature of the thermostat 41 is set lower than the target coolant temperature in the cylinder block portion 21 and higher than the condensation temperature of the EGR gas, the cylinder head temperature Th can be adjusted at the optimum temperature thereof easily. The cylinder block temperature Ts can be increased to be the optimum temperature thereof by reducing the cylinder-block flow rate Vs.

Although the present disclosure has been fully described in connection with the exemplar embodiment thereof with reference to the accompanying drawings, it is to be noted that various changes and modifications described below will become apparent to those skilled in the art.

Figure 3:
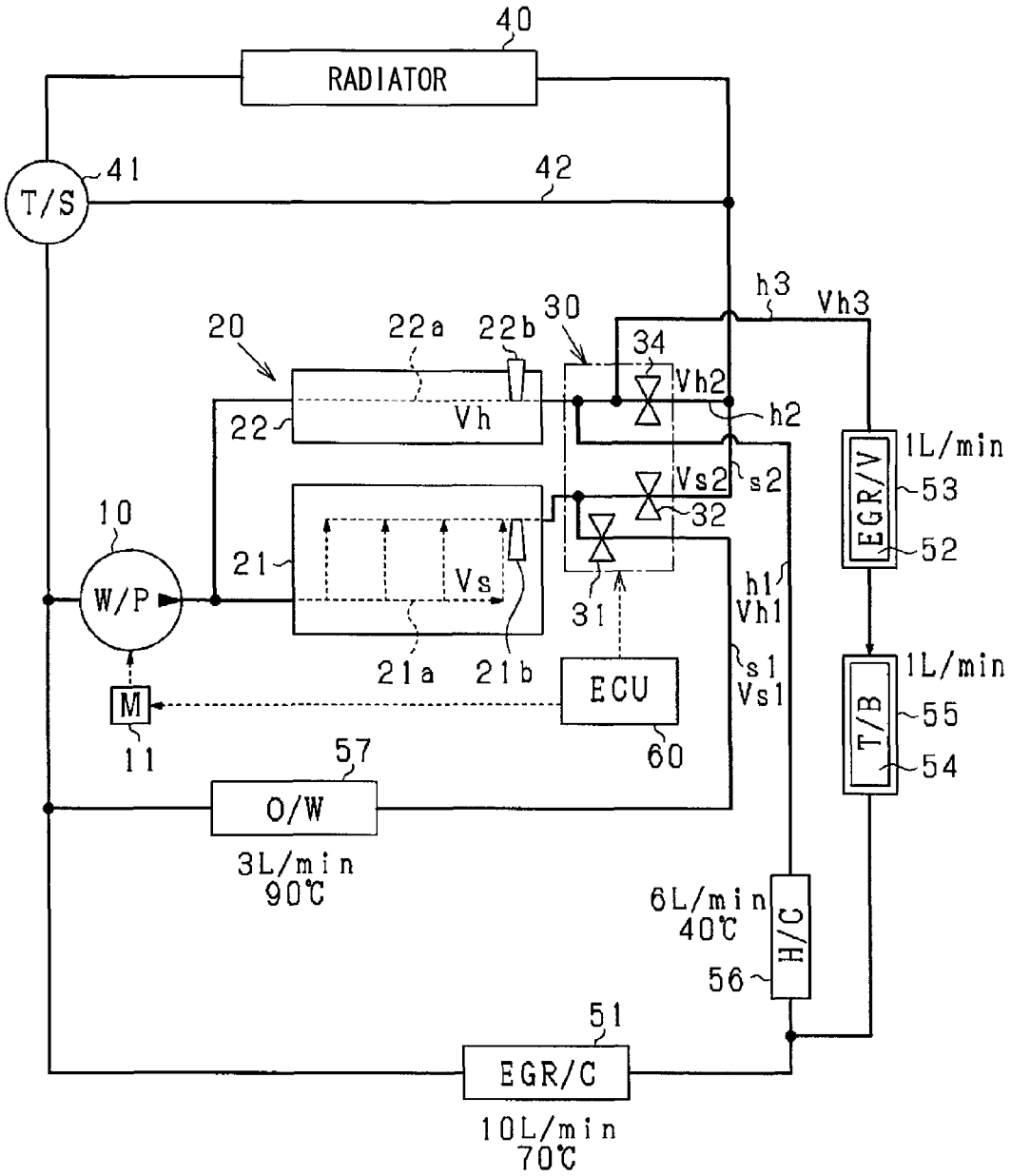
FIG. 3 is a schematic diagram showing a coolant circulation system for an engine, according to a modification of the present disclosure.

In the above-described exemplar embodiment, the pump 10 is mechanically operated by drive force of the engine 20. Alternatively, a pump electrically operated by drive force generated by an electric motor 11 may be used as the pump 10, as shown in FIG. 3. In this case, the electric motor 11 may be controlled by the ECU 60, and the control valve 33 may be omitted as shown in FIG. 3. Even when the control valve 33 is omitted in this case, the control valve unit 30 is capable of controlling the cylinder-block flow rate Vs and the cylinder-head flow rate Vh respectively. Furthermore, a discharge capacity of the pump 10 can be controlled so as to keep the flow rates Vh2, Vs2 of the coolant flowing to the radiator 40 at zero until the coolant temperature reaches the preset temperature of the thermostat 41. Thus, the bypass passage 42 can be omitted. As a result, when the electric pump is adopted as the pump 10, the number of control valves of the control valve unit 30 can be reduced, and the bypass passage 42 can be omitted.

In the above-described exemplar embodiment, two-way valves are adopted as the control valves 31 to 34 of the control valve unit 30, which control a communication state between two passages. Alternatively, three-way valve may be adopted as the control valves of the control valve unit 30, which control a communication state among three passages. In this case, the number of the control valves of the control valve unit 30 can be reduced. For example, the control valve unit 30 may include a three-way valve that controls a communication state among the cylinder head passage 22*a*, the distribution passage h1 and the radiator passage h2, and a three-way valve that controls a communication state among the cylinder block passage 21*a*, the distribution passage s1 and the radiator passage s2. These three-way valves switch the communication states and adjust a flow rate of each of the passages.

Additional advantages and modifications will readily occur to those skilled in the art. The disclosure in its broader terms is therefore not limited to the specific details, representative apparatus, and illustrative examples shown and described.

What is claimed is:

1. A coolant circulation system for an engine that includes a cylinder block portion and a cylinder head portion, the coolant circulation system comprising:

a cylinder block passage provided in the cylinder block portion to serve as a passage through which a coolant flows to cool the cylinder block portion, a cylinder head passage provided in the cylinder head portion to serve as a passage through which the coolant flows to cool the cylinder head portion, wherein the cylinder block passage and the cylinder head passage are connected in parallel to each other;

a first heat exchanger connected to an outlet of the cylinder block passage without being connected to an outlet of the cylinder head passage;

a second heat exchanger connected to the outlet of the cylinder head passage without being connected to the outlet of the cylinder block passage;

a radiator connected to both the outlet of the cylinder block passage and the outlet of the cylinder head passage, such that coolant from the outlet of the cylinder block passage and the outlet of the cylinder head passage flows through the radiator before returning to the cylinder block passage or the cylinder head passage;

a control valve unit including a first control valve that controls a flow rate of the coolant flowing through the cylinder block passage, and a second control valve that controls a flow rate of the coolant flowing through the cylinder head passage, the control valve unit being capable of controlling the flow rate of the coolant flowing through the cylinder block passage and the flow rate of the coolant flowing through the cylinder head passage respectively, wherein the radiator is configured to be connected to both the outlet of the cylinder block passage and the outlet of the cylinder head passage when the first heat exchanger is connected to the outlet of the cylinder block passage without being connected to the outlet of the cylinder head passage and when the second heat exchanger is connected to the outlet of the cylinder head passage without being connected to the outlet of the cylinder block passage.

2. The coolant circulation system according to claim 1, wherein the first heat exchanger is a heat exchanger in which a desired flow rate of the coolant for heat exchange therein is lower than a predetermined value, and the second heat exchanger is a heat exchanger in which a desired flow rate of the coolant for heat exchange therein is higher than the predetermined value.

3. The coolant circulation system according to claim 1, wherein the second heat exchanger includes an EGR cooler that cools EGR gas through heat exchange with the coolant flowing therethrough, and the EGR gas is a part of exhaust gas flowing back to an intake side of the engine.

4. The coolant circulation system according to claim 3, further comprising:

a first bypass passage through which the coolant bypasses the radiator; and a thermostat that controls the coolant to flow through the first bypass passage when a temperature of the coolant is equal to or lower than a preset temperature of the thermostat, wherein the preset temperature of the thermostat is set higher than a temperature below which moisture contained in the EGR gas condenses, and lower than a target coolant temperature in the cylinder block portion, and the target coolant temperature in the cylinder block portion is a temperature at which a friction loss between the cylinder block portion and the pistons is lower than a predetermined value.

5. The coolant circulation system according to claim 2, wherein the first heat exchanger includes an oil warmer that heats lubricant oil used for the engine.

6. The coolant circulation system according to claim 2, wherein the second heat exchanger includes a heater core that exchanges heat with conditioned air, the coolant circulation system further comprising:

a second bypass passage connected to the outlet of the cylinder head passage without being connected to the outlet of the cylinder block passage, the second bypass passage bypassing the heater core, and a third heat exchanger provided in the second bypass passage, the third heat exchanger being a heat exchanger in which a desired flow rate of the coolant for heat exchange therein is lower than that in the first heat exchanger.

7. The coolant circulation system according to claim 6, wherein the control valve unit adjusts a flow rate of the coolant flowing through the heater core at a heater-core flow rate when a temperature of the coolant is higher than a reference temperature below which the conditioned air is heated insufficiently, and the control valve unit adjusts the flow rate of the coolant flowing though the heater core at a flow rate lower than the heater-core flow rate when the temperature of the coolant is equal to or lower than the reference temperature.

8. The coolant circulation system according to claim 1, wherein the control valve unit includes at least one valve provided downstream of the cylinder block passage in a coolant flow, and at least one valve provided downstream of the cylinder head passage in a coolant flow.

9. The coolant circulation system according to claim 8, wherein the first heat exchanger is connected to the outlet of the cylinder block passage via a first distribution passage, the second heat exchanger is connected to the outlet of the cylinder head passage via a second distribution passage, and the first control valve is provided in the first distribution passage, and the second control valve provided in the second distribution passage.

10. The coolant circulation system according to claim 8, wherein the radiator is connected to the outlet of the cylinder block passage via a first radiator passage and the outlet of the cylinder head passage via a second radiator passage, and the control valve unit includes a third control valve provided in the first radiator passage to control a flow rate of the coolant flowing therethrough, and a fourth control valve provided in the second radiator passage to control a flow rate of the coolant flowing therethrough.

11. The coolant circulation system according to claim 1, further comprising a pump connected to the engine to supply the coolant to the engine.

12. The coolant circulation system according to claim 11, wherein the pump is electrically operated by a drive force generated by an electric motor.

13. The coolant circulation system according to claim 1, wherein the cylindrical portion accommodates therein pistons, and the cylinder head portion defines a combustion chamber.

14. The coolant circulation system according to claim 6, wherein the third heat exchanger includes a cooling jacket that cools an EGR valve.

15. The coolant circulation system according to claim 6, wherein the third heat exchanger includes a cooling jacket that cools a throttle valve which adjusts a flow rate of intake air.

16. The coolant circulation system according to claim 6, wherein the second bypass passage is connected to the cylinder head passage without going through the control valve.

17. The coolant circulation system according to claim 9, wherein the radiator is connected to the outlet of the cylinder block passage via a first radiator passage branched from the first distribution passage, the radiator is connected to the outlet of the cylinder head passage via a second radiator passage branched from the second distribution passage, and the control valve unit includes a third control valve provided in the first radiator passage to control a flow rate of the coolant flowing therethrough, and a fourth control valve provided in the second radiator passage to control a flow rate of the coolant flowing therethrough.

* * * * *